US005149575A

United States Patent [19]

Soifer

[11] Patent Number: 5,149,575

[45] Date of Patent: Sep. 22, 1992

[54] CORNER EDGE BUMPERS

[76] Inventor: Martin T. Soifer, 7208 Montrico Dr., Boca Raton, Fla. 33433

[21] Appl. No.: 599,314

[22] Filed: Oct. 17, 1990

[51] Int. Cl.[5] ..... A47B 95/00

[52] U.S. Cl. ..... 428/188; 428/343; 428/192; 428/40; 52/288; 52/716; 248/345.1

[58] Field of Search ..... 428/40, 122, 188, 343; 52/288, 716; 108/72; 248/345.1

[56] References Cited

U.S. PATENT DOCUMENTS

| | | | |
|---|---|---|---|
| 1,821,692 | 9/1931 | Copeland | 206/586 |
| 2,266,181 | 12/1941 | Epps | 206/586 |
| 2,376,530 | 5/1945 | Dittmann | 206/586 |
| 3,030,728 | 4/1962 | Wesman | 206/586 |
| 3,041,775 | 7/1962 | Brown et al. | 206/586 |
| 3,047,142 | 7/1962 | Heffley | 206/453 |
| 3,049,260 | 8/1962 | Stone | 206/586 |
| 3,072,313 | 1/1963 | Svendsen | 206/586 |
| 3,150,854 | 9/1964 | Jamieson | 248/345.1 |
| 3,244,347 | 4/1966 | Jenk | 206/586 |
| 3,358,725 | 12/1967 | Bussard et al. | 150/51 |
| 3,451,709 | 6/1969 | Swagger | 248/345.1 |
| 3,531,040 | 9/1970 | Myny | 206/586 |
| 3,645,387 | 2/1972 | Hunt | 206/453 |
| 3,901,995 | 8/1975 | Conlon | 206/586 |
| 3,922,408 | 11/1975 | Smith | 248/345.1 |
| 4,012,878 | 3/1977 | Ellingson | 52/288 |
| 4,072,231 | 2/1978 | Helms | 206/453 |
| 4,106,739 | 8/1978 | Gasser | 248/345.1 |
| 4,120,441 | 10/1978 | Hurley | 206/586 |
| 4,202,449 | 5/1980 | Bendt | 206/586 |
| 4,482,054 | 11/1984 | Gardner | 206/594 |
| 4,483,444 | 11/1984 | Gardner | 206/453 |
| 4,742,916 | 5/1988 | Galea | 206/586 |
| 4,852,744 | 8/1989 | Van Breemen | 248/345.1 |
| 4,877,673 | 10/1989 | Eckel | 206/586 |

OTHER PUBLICATIONS

ASME publication, Dec. 1969 entitled "The Linearization of the Prebuckling State and its Effect on the Determined Instability Loads".

A text, The Theory of Elastic Stability, by Timoshenko, published Dec. 1961.

*Primary Examiner*—Alexander S. Thomas

*Attorney, Agent, or Firm*—Quarles & Brady

[57] ABSTRACT

The bumper of the present invention is utilized in conjunction with a corner edge of a table, piece of furniture, counter or similar article. The bumper includes a corner edge cover having wall segments overlaid on the corner sidewalls. The cover wall segments are joined to form an angle which corresponds to the geometric configuration of the underlying corner structure. A resilient shield wall includes a substantially semi-cylindrical wall segment, spaced away from the corner edge cover by an optimized stand-off distance, and tangentially extending wall segments bridging opposing sides of the arcuate wall segment with outer regions of the cover wall segments. The corner edge cover and the shield wall are integral and are geometrically configured to optimally absorb energy of an impact through deformation of the shield wall and distribution of the impact load over the cover wall segments and top plate. A top plate is integrally connected to the top edges of the corner wall segments to enhance the energy absorption capabilities of the bumper and provide a convenient surface for removably mounting the bumper to the corner structure with double-backed adhesive film.

13 Claims, 3 Drawing Sheets

CORNER EDGE BUMPERS

BACKGROUND OF THE INVENTION

1. Field of the Invention

The present invention relates to bumpers for corner edges such as edges on tables, counters and other items that have sharp corners and particularly to removable bumpers for corner edges.

2. Prior Art

U.S. Pat. No. 4,012,878 to Ellingson discloses a wall guard having an underlying layer conforming to a wall and covering a wall edge and a second overlying layer spaced from the underlying layer. Both layers intersect at outboard regions remote from the wall edge. The specific geometric configuration, thickness, and energy absorption characteristics of the Ellingson wall guard are not disclosed.

U.S. Pat. No. 4,072,231 to Helms discloses a corner protector having a pie-shaped top surface and a pair of curved side walls extending downwardly from the top surface. Curved side walls define an air pocket between the side walls of the protector and the side walls of the counter top or table. U.S. Pat. No. 4,483,444 to Gardner discloses a packaging system. The packaging system includes a corner post that is inserted into a container. The insert has bulbs or protrusions resting against the interior sides of the packaging container and has interior walls spaced from those protrusions to butt the material contained in the container.

U.S. Pat. No. 4,482,054 to Gardner discloses a support and cushioning tube consisting of a plurality of tubes joined together forming air pockets to cushion the material contained within the container. U.S. Pat. No. 4,106,739 to Gasser discloses a bumper edge member that defines a completely enclosed air chamber to cushion impact.

U.S. Pat. No. 3,451,709 to Swagger discloses a side wall and fender protector. U.S. Pat. No. 3,358,725 to Bussard et al discloses a guard structure for the rims of canvas baskets. The guard structure is simply wrapped around the rim of the basket. U.S. Pat. No. 3,244,347 to Jenk discloses corner post construction that is a collapsed tube inserted into the corners of a container. U.S. Pat. No. 2,376,530 to Dittmann discloses solid block corner edge protectors that are inserted into containers to hold materials stored within the containers. U.S. Pat. No. 1,821,692 to Copeland discloses a packing case having corrugated corner pieces for isolating materials stored in the packing case from impact.

U.S. Pat. No. 4,742,916 to Galea discloses corner and edge protectors that are placed in containers. The protectors are molded fiber that conform to the corners and edges of items that are placed within containers. U.S. Pat. No. 4,202,449 to Bendt discloses a protection device for edges of items that are placed within containers. U.S. Pat. No. 4,120,441 to Hurley discloses angle edge guards that protect edges of items placed within containers. U.S. Pat. No. 4,877,673 to Eckel discloses a corner edge protector for items placed within containers. U.S. Pat. No. 4,852,744 to Van Breemen and U.S. Pat. No. 3,901,995 to Conlon disclose edge protector devices that support or protect edges of items placed within containers.

The following references also disclose devices which protect corners and edges of materials placed in containers: U.S. Pat. No. 3,645,387 to Hunt; U.S. Pat. No. 3,531,040 to Myny; U.S. Pat. No. 3,072,313 to Svendsen; U.S. Pat. No. 3,049,260 to Stone; and, U.S. Pat. No. 2,266,181 to Epps.

U.S. Pat. No. 3,030,728 to Wesman discloses cushioning pieces for corners. The cushioning pieces form a plurality of air bubbles or voids next to the corner surfaces. U.S. Pat. No. 3,041,775 to Brown et al. discloses a table corner guide that is a unitary block of material placed on the top surface of a table. U.S. Pat. No. 3,047,142 to Heffley discloses a mirror corner protector having bulbs approximate the corner edge of the mirror and along adjacent side edges.

U.S. Pat. No. 3,150,854 to Jamieson discloses a body guard device for protecting the corner edges of furniture. The body guard device has a cylindrically shaped or bulbous protrusion adjacent the corner edge of the furniture. The Jamieson disclosure does not discuss in detail the geometric relationship between the cylindrical shield and the balance of the protector.

An ASME publication was presented during a conference on Nov. 16-20, 1969 entitled "The Linearization of the Pre-buckling State and its Effect on the Determined Instability Loads" by Kerr and Soifer. This publication discusses the instability phenomena of elastic solids and provides nonlinear equations describing the action of those elastic solids under varying loads. The equations describe the performance of a shallow arch with fixed boundaries subjected to a uniformly distributed load. A text, The Theory of Elastic Stability, by Timoshenko, published in 1961, discloses the buckling of uniformly compressed circular arches and particularly the critical load for arches with varying angles and boundary conditions.

OBJECTS OF THE INVENTION

It is an object of the present invention to provide a bumper for corner edges which incorporates an energy absorption design to provide superior cushioning upon impact.

It is another object of the present invention to provide a bumper wherein the materials selected also contribute to the energy absorption of the bumper.

It is a further object of the present invention to provide a bumper which is elastic and which returns to its original geometric configuration subsequent to impact.

It is a further object of the present invention to provide a bumper which can be repeatedly mounted onto a corner edge and removed without damage to the underlying corner structure.

It is an additional object of the present invention to provide a bumper which can be easily manufactured at a relatively low cost.

SUMMARY OF THE INVENTION

The bumper of the present invention is utilized in conjunction with a corner edge of a table, a piece of furniture, counter, or similar article. The bumper includes a corner edge cover having wall segments overlaid on the article surfaces adjacent the corner edge. The cover wall segments are joined together proximate the corner edge and extend therefrom to form an angle which corresponds to the configuration of the underlying corner. A resilient shield wall includes a substantially semi-cylindrical wall segment, spaced away from the corner edge cover, and tangentially extending wall segments bridging opposing sides of the substantially semi-cylindrical wall segment with respective outer regions of the cover wall segments. The corner edge cover and the shield wall are integral and are geometrically configured to maximize the absorption of impact energy principally through deformation of the shield wall and to distribute the impact load over the cover wall segments via the tangential shield wall segments.

A top plate attaches to the upper edges of the cover wall segments to permit vertical support of the bumper. The top plate partially absorbs the impact energy distributed to the corner wall segments, thereby enhancing the energy absorption capabilities of the bumper. The top plate also maintains structural integrity by preventing the separation of the corner wall segments from the underlying corner surfaces during central and off-center impacts. Further, the top plate provides a convenient surface for applying reusable adhesives so that the bumper can be attached, readily removed and subsequently reattached to a furniture corner without affecting the underlying finish.

BRIEF DESCRIPTION OF THE DRAWINGS

Further objects and advantages of the present invention can be found in the detailed description of the preferred embodiments when reviewed in conjunction with the accompanying drawings in which.

DETAILED DESCRIPTION OF THE PREFERRED EMBODIMENTS

The present invention relates to a bumper for corner edges commonly present on tables, counter tops, cabinets and other areas that pose a danger of injury to persons or objects which may impact or hit the exposed corner edge.

Figure 1:
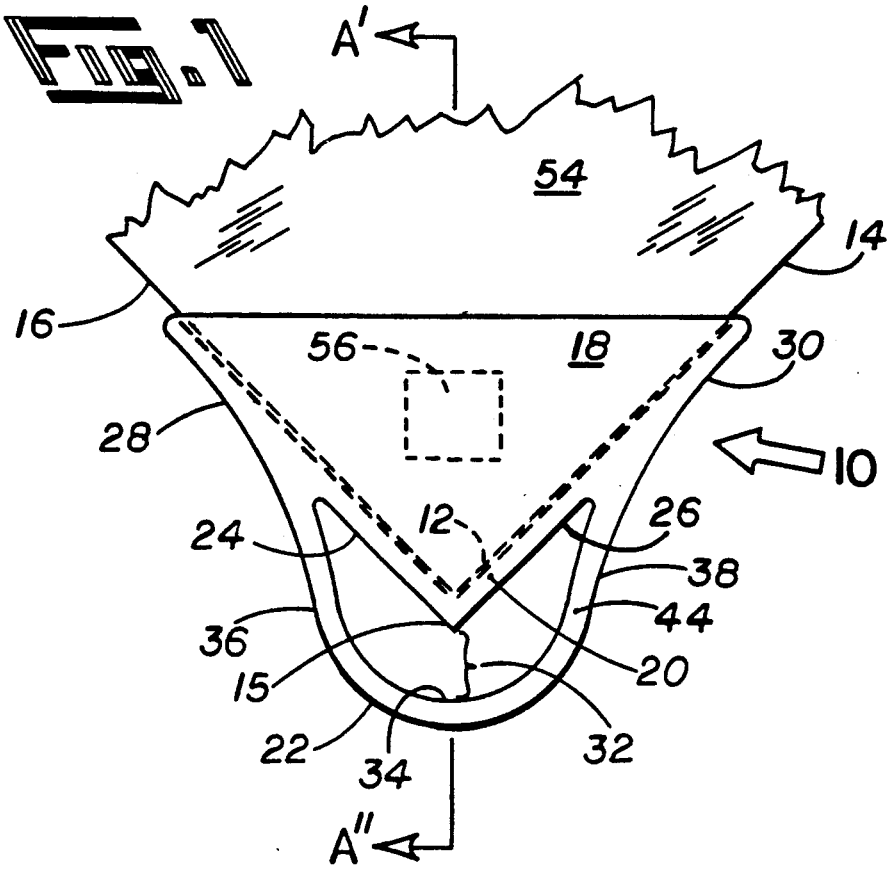
FIG. 1 illustrates a top view of one embodiment of the corner edge bumper in accordance with the principles of the present invention.
Figure 2:
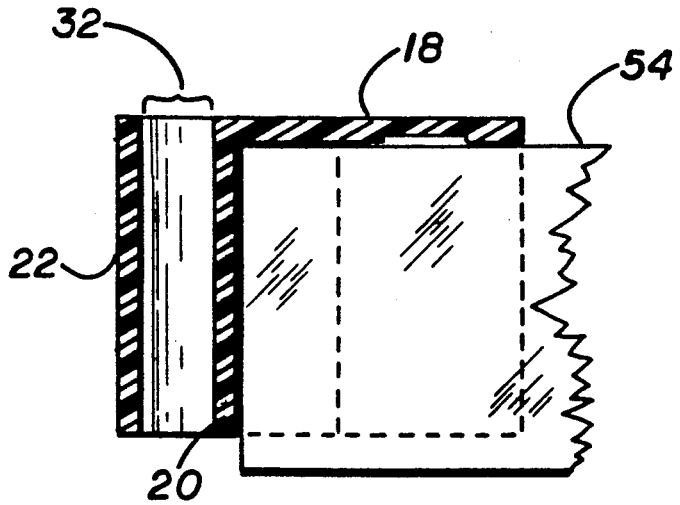
FIG. 2 illustrates a cross-sectional view of the corner edge bumper from the perspective of section line A—A in FIG. 1.

FIG. 1 illustrates a top view of bumper 10, and FIG. 2 illustrates a cross-sectional view of bumper 10 in the perspective of section line A—A in FIG. 1. Bumper 10 encases corner edge 12, shown in cross-section in FIG. 2 and by phantom lines in FIG. 1. Corner edge 12 is formed at the intersection of corner side walls 14 and 16.

In the preferred embodiment, bumper 10 includes a top plate 18, a corner edge cover 20 and a shield wall 22. Corner edge cover 20 comprises cover wall segments 24 and 26 which overlay corner sidewalls 16 and 14, respectively, when bumper 10 is applied to a corner of article 54. Cover wall segments 24 and 26 are joined together or formed integrally to provide a junction 15 corresponding to the corner edge 12 and extend outwardly. The cover wall segments 24 and 26 can form a variety of angles. As shown in FIG. 1, the cover wall segments 24 and 26 are in perpendicular arrangement so that the bumper 10 can be mounted to traditional right angle corners. However, it is possible to construct the bumper 10 so that cover wall segments 26 and 28 form acute or obtuse angles to match various corner configurations.

Shield wall 22 is generally connected to cover wall segments 24 and 26 and spaced outwardly from junction 15 by a distance 32, also referred to herein as the stand-off distance $\delta$. Shield wall 22 is preferably formed to provide an arcuate shield wall segment 34 and tangentially extending shield wall legs 36 and 38 which connect to the outer regions 28 and 30 of the corresponding cover wall segments 24 and 26.

In order to optimize the performance of bumper 10 under impact, several parameters in the design of bumper 10 are coordinated. These parameters include the arch radius of arcuate wall segment 34, the wall thickness 44 of arcuate wall segment 34, the stand-off distance 32, the durometer of the material used to form bumper 10 and the contour or geometric shape of arcuate wall segment 34.

The contour of the arcuate wall segment 34 is preferably a cylindrical sector with an arcuate span of 150°-210° for a right angle corner. The use of a cylindrical sector provides a rounded, non-sharp impact surface. Additionally, this curved surface facilitates the deflection of off-center impacts. Further, the cylindrical contour of arcuate wall segment 34 undergoes predictable deformation under impact, thereby facilitating the design to maximize energy absorption.

The selection of material durometer and wall segment thickness 44 are governed by the desired impact surface stiffness. Accordingly, when a cylindrical sector contour is used for arcuate wall segment 34 and the material durometer and wall thickness 44 are selected, the energy absorption capabilities of bumper 10 become a function of the stand-off distance 32 as explained below.

Figure 5:
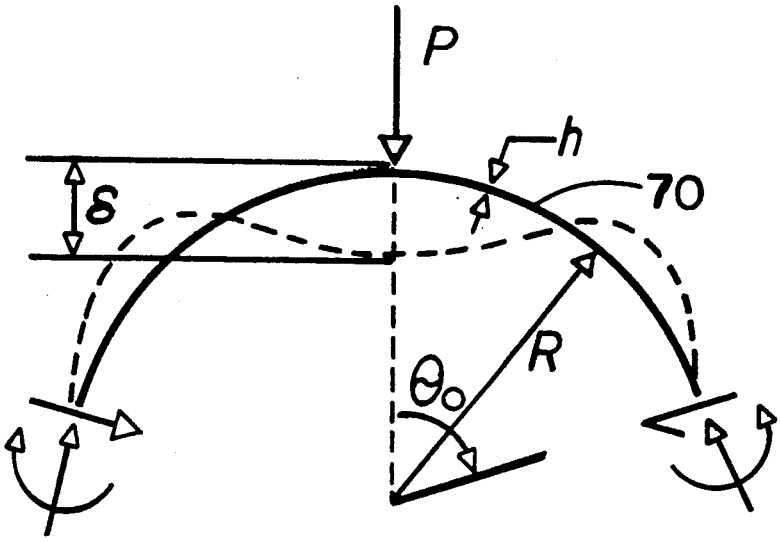
FIG. 5 diagrammatically illustrates deformation of an elastic arch.

The characteristic behavior of an arcuate impact surface, such as arcuate wall segment 34, under a centrally applied force is diagrammatically represented in FIG. 5. The load P represents the resultant of a uniform impact pressure. The application of load P to the symmetric center of the arch 70 models the most hazardous impact to bumper 10 because of the direct alignment of the arch center with the underlying corner 12.

The dashed curve represents the characteristic deformed shape of the arcuate impact surface under load P. The arch 70 has a wall thickness h, a half-angle $\theta_o$, a mean arch radius R and a deformation distance $\delta$. The deformation distance $\delta$ corresponds generally to the stand-off distance 32 in bumper 10.

In FIG. 5, arch 70 has relaxed boundary conditions, providing reaction forces and moments which restrict, but do not prevent, displacement and rotation of the outer ends of arch 70.

Figure 6:
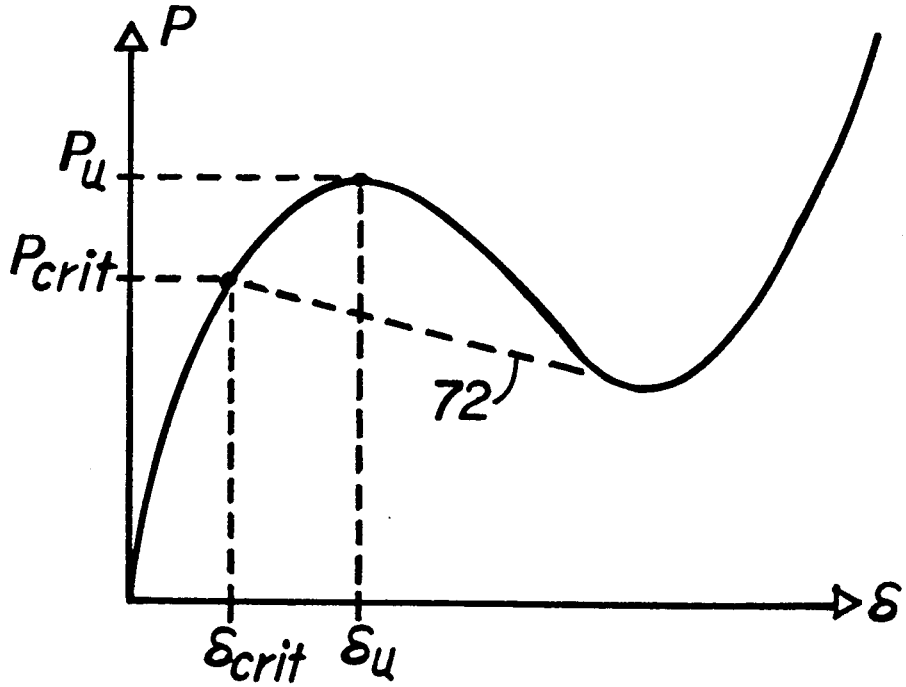
FIG. 6 is an exemplary load-displacement curve for the arch shown in FIG. 5.

Referring to FIG. 6, the impact performance of arch 70 in FIG. 5 is represented by a characteristic load-displacement curve. The solid curve 74 illustrates the primary equilibrium path with symmetric arch deformation. The dashed curve 72 beginning at $P_{crit}$ bifurcates from the symmetrical curve at $\delta_{crit}$ and illustrates a secondary equilibrium path with unsymmetric arch deformation.

It has been shown in "The Linearization of the Prebuckling State and its Effect on the Determined Instability Loads" by Kerr and Soifer, ASME Paper No. 60-WA/APM-1, 1969, that bifurcation in the load-displacement relationship occurs at $\delta_{crit}$ when an arch parameter K is greater than 5.02. Arch parameter K is defined in Equation 1 that follows.

$$K = \frac{R}{h}\theta_o^2 \qquad \text{Equation 1.}$$

Where:

R = mean radius of arch $\theta_o$ = half angle h = wall thickness

Accordingly, when the mean radius, half angle, and wall thickness are selected so that arch parameter K is less than or equal to 5.02, the arch deforms only symmetrically, absorbing energy with increasing load and deformation. For bumpers having arch parameters in that range, the stand-off distance is preferably no greater than $\delta_u$ depicted in FIG. 6 since the primary energy absorption level maximizes at impact force parameter $P_u$.

However, when arch parameter K is greater than 5.02, the arch deforms symmetrically absorbing energy with increasing load and deformation until $P_{crit}$ is applied and a deformation of $\delta_{crit}$ is reached. At that point, the arch dynamically "snaps through" to an inverted form, thereby releasing the absorbed energy. Consequently, to maximize absorption of energy in the bumper itself and reduce the likelihood of inversion, the stand-off distance $\delta$, for arch parameters $K > 5.02$, preferably equals $\delta_{crit}$.

Referring again to FIG. 6, the load-displacement curve represents the characteristic performance of an arch under a centrally applied load. The particular amplitude and width of the curve varies according to the boundary conditions and arcuate angle of the arch. As the boundary conditions are relaxed from the fixed conditions prescribed and analyzed by Kerr and Soifer in the above cited reference, the critical load $P_{crit}$ decreases and the corresponding displacement $\delta_{crit}$ increases. However, the performance trend represented by the shape of the characteristic curve remains essentially the same.

To apply the theoretical model to the optimal design of bumper 10, the following Equations 2 and 3 are used to determine the preferred stand-off distance 32 between corner 12 and the center of arcuate wall segment 34.

When $K > 5.02$ — Equation 2.

$$\delta = \delta_{crit} = hK\left[-0.1555\left(3 + 2\left(1 - \frac{25.24}{K^2}\right)^{\frac{1}{2}}\right)\gamma + 0.7775\right]$$

When $K \leqq 5.02$ — Equation 3.

$$\delta = \delta_u = hK\left[\gamma\frac{\lambda}{\eta^2}K - 1\right]\left[\frac{1-\cos\eta}{\eta\sin\eta} - \frac{1}{2}\right]$$

Where $\lambda$ and $\eta$ are a solution pair of the characteristic Equation 4.

Equation 4.

$$\frac{\lambda^2K^2}{\eta^4}\left[4 - \frac{5\eta^2}{3} - 3\eta\cot\eta - \eta^2\cot^2\eta\right] -$$

-continued $$2\lambda\frac{K}{\eta^2}[2 - \eta^2 + \eta\cot\eta - \eta^2\cot^2\eta] +$$

$$\left[\eta\cot\eta - \eta^2\cot^2\eta - \frac{1\eta^2}{3} - \frac{\eta^4}{3K^2}\right] = 0$$

The modifying factor $\gamma$ in Equations 2 and 3 is the ratio of the buckling load with relaxed boundary conditions to its value with fixed boundary conditions and adjusts the stand-off distance values for the differences in arcuate angles and boundary conditions from fixed to relaxed. Table 1 which follows sets forth numerical values for the buckling loads with relaxed and fixed boundary conditions for different arch angles. Table 1 is extracted from Table 7-2 in the text, Theory Elastic Stability, by Timoshenko, 1961.

TABLE 1

| Total Arch Angle | Fixed Boundaries | Relaxed Boundaries |
|---|---|---|
| 30° | 294 | 162 |
| 60° | 73.3 | 40.2 |
| 90° | 32.4 | 17.4 |
| 120° | 18.1 | 10.2 |
| 150° | 11.5 | 6.56 |
| 180° | 8.0 | 4.61 |

Accordingly, when the arch parameter K is less than or equal to 5.02, the arcuate wall segment 34 deforms only symmetrically, following the solid load-displacement curve 74 in FIG. 6. When K is greater than 5.02, arcuate wall segment 34 deforms symmetrically until $P_{crit}$ at $\delta_{crit}$ is reached and then unsymmetrically following the dashed line 72 in FIG. 6.

Using the above calculations, the bumper 10 can be preferably designed to provide a stand-off distance 32 which maximizes the energy absorption capabilities of bumper 10. For bumpers with an arch parameter $K > 5.02$, the performance of bumper 10 is optimized by preventing a "snap through" inversion of arcuate wall segment 34 prior to contact with corner edge 12. For bumpers designed with an arch parameter $K \leqq 5.02$, performance is optimized by maintaining increased energy absorption through deformation of arcuate wall segment 34 until contact with corner edge 12.

To further enhance the energy absorption capabilities of bumper 10, top plate 18 is preferably connected to the upper edges of cover wall segments 24 and 26. Preferably, top plate 18 is integrally formed with the top edges of cover wall segments 24 and 26 and constructed of the same material as cover wall segments 24 and 26 and shield wall 22.

Top plate 18 prevents the separation of cover wall segments 24 and 26 from the underlying sidewalls 14 and 16. During impact, the impact energy imparted on shield wall 22 is partially absorbed by the deformation of shield wall 22 according to the performance characteristics discussed above. The geometric configuration of arcuate wall segment 34 and shield wall legs 36 and 38 cause a portion of the energy to be distributed to the outer regions 28 and 30 of cover wall segments 24 and 26.

Under a load applied to the center of arcuate wall segment 34, the forces distributed to cover wall segments 24 and 26 urge the inner portions of corner wall segments 24 and 26 adjacent cover junction 15 away from the underlying corner walls 14 and 16. This separation outwardly displaces the connection points of shield wall 22 and corner wall segments 24 and 26, thereby diminishing the stiffness of shield wall 22.

By preventing the separation of cover wall segments 24 and 26, top plate 18 creates stiffer boundary conditions for shield wall 22. With stiffer boundary conditions, bumper 10 can absorb greater impact energy for a given displacement $\delta$ of shield wall 22. Additionally, top plate 18 partially absorbs the impact energy through tensile strain created in top plate 18 by the forces distributed to corner wall segments 24 and 26.

Top plate 18 further enhances the performance of bumper 10 during off-center impact. Application of impact loads on shield wall legs 36 and 38 urges the outer portions 28 and 30 of corner wall segments 24 and 26 to separate from corner sidewalls 14 and 16. This separation of outer portions 28 and 30 is prevented by top plate 18, thereby reducing the displacement of shield wall 22 for a given impact load.

In addition to improving the energy absorption capabilities of bumper 10 under both central and side impacts, top plate 18 permits vertical support of the bumper structure when applied to the corner of article 54. Top plate 18 is disposed on the top surface of article 54 and provides a convenient surface for applying adhesive material to secure bumper 10 to article 54.

Preferably, the underside of top plate 18 accommodates a double-backed adhesive film 56. The adhesive film preferably provides permanent adhesive to securely attach to top plate 18 and peelable adhesive for temporary attachment to the top surface of the article corner. Alternatively, any adhesive material which permits repeated attachment and removal of bumper 10 to article 54 without damage to the article finish can be used.

Top plate 18 can alternatively be constructed to provide a tab (not shown) for accommodating adhesive film 56. This optional tab can be formed to provide a flexible central portion of top plate 18 to facilitate application and removal of bumper 10.

Figure 3:
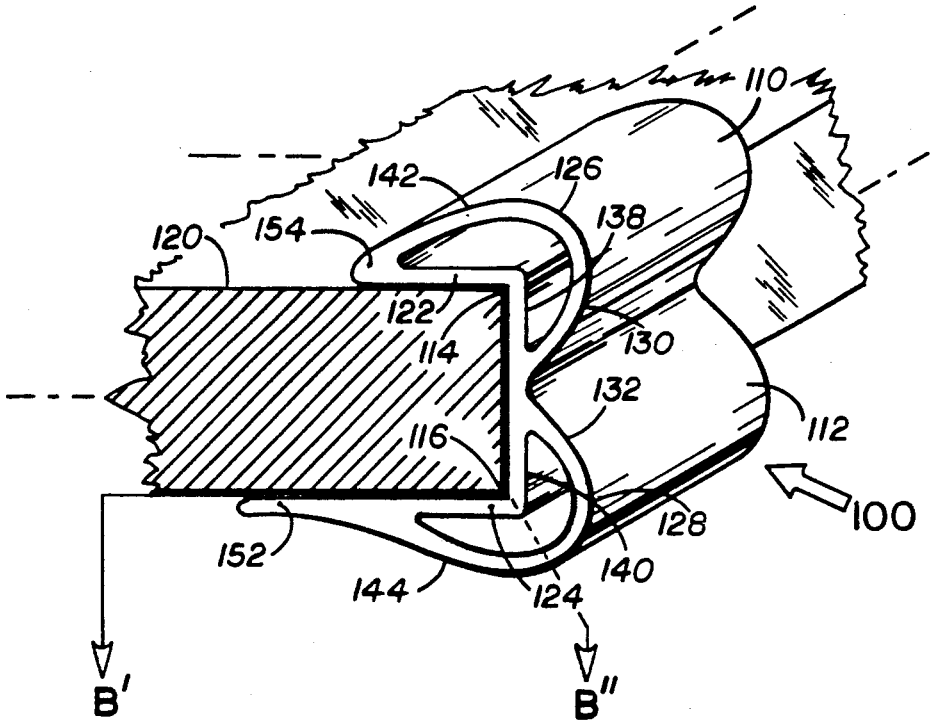
FIG. 3 illustrates a perspective view of a dual corner edge bumper used in conjunction with an extending plate or table edge.

Referring to FIG. 3, the corner edge bumper can be adapted for application to blunt corners, such as table ends, which comprise two edges. In this embodiment, a dual edge bumper 100 generally includes two corner edge bumper portions 110 and 112 covering two corner edges 114 and 116. Corner edges 114 and 116 can be part of an extending plate 120, such as a table top or an extending counter top lip having upper and lower sharp corner edges. Bumper portions 110 and 112 include respective corner edge covers 122 and 124, arcuate shield wall segments 126 and 128 and associated tangential shield wall legs 130, 132, 142 and 144. Adjacent shield wall legs 130 and 132 extend from arcuate wall segments 126 and 128 and connect to adjoining cover wall segments 138 and 140. Outer shield wall legs 142 and 144 extend tangentially from arcuate shield wall segments 126 and 128 to connect to the corner edge covers 122 and 124.

Cover wall segments 138 and 140 are preferably integrally connected. Adjacent tangential wall segments 130 and 132 can be further separated for thick plates to maintain the optimized impact absorption characteristics of the each bumper with respect to the its particular corner edge.

Figure 4:
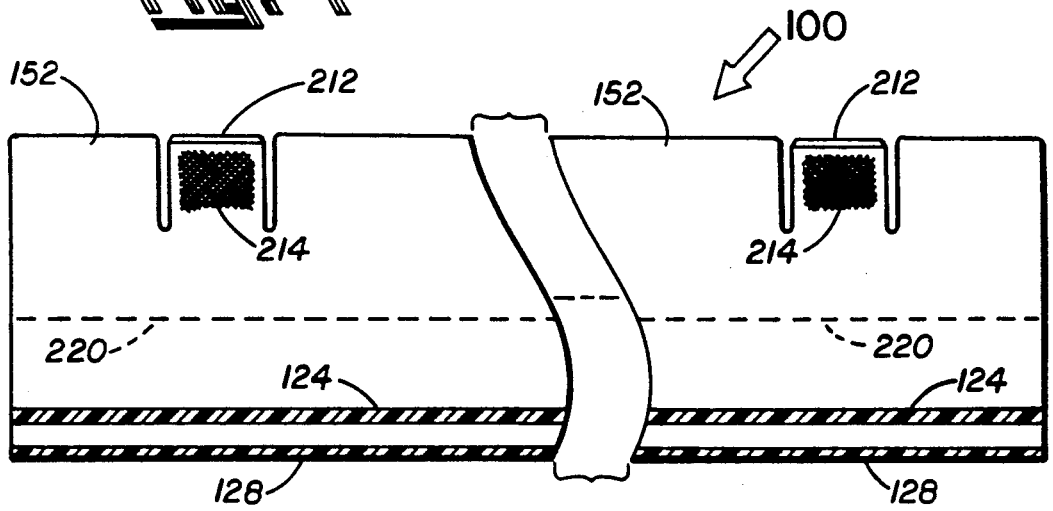
FIG. 4 illustrates a cross-sectional view along section line B—B in FIG. 3, extended to show the bumper as an elongated strip.

The outer portions of corner edge covers 122 and 125 can be extended, as shown by extension 154, to provide greater adhesion surface area and optional tab 212, shown in FIG. 4.

FIG. 4 illustrates a cutaway view along section line B—B in FIG. 3. The dual edge bumper 100 is extended to illustrate an elongated configuration for covering a substantial length of a table edge. Outer region 152 includes the option of a tab 212 carrying adhesive 214. The adhesive 214 is placed on the inboard side of the optional tab 212, which facilitates the removal of bumper 100 from the underlying article. Shield wall 128 is preferably spaced apart from corner edge cover 124 as described earlier. The intersection between the shield wall and the outer region of the cover wall segment is shown as dashed line 220.

The bumper 10 is preferably an integral item and is made of an elastic material that upon impact, deforms and then returns to its original geometric shape. Preferably, a low migration plastic having a durometer (a measure of elasticity) in a range from 75 to 95 Shore A. Most preferably, a low migration PVC having 85 Shore A durometer is utilized as the material.

With the selection of a material durometer in the preferred range, an example of one preferred bumper design can be determined as follows:

$$h = 0.08''$$

$$R = \left(0.500'' - \frac{h}{2}\right) = 0.460''$$

$$\theta_o = 75^\circ = 1.309 \text{ rad.}$$

from Table 1, $$\gamma = \frac{6.56}{11.5} = 0.57;$$

from Eq. 1, $K=9.85$;

from Eq. 2, since $K>5.02$, $\delta=\delta_{crit}=0.231''$.

Having described and illustrated the preferred embodiments of the present invention, it is intended that the scope of the invention not be limited by such description and illustration but only by a reasonable interpretation of the appended claims. The claims appended hereto are meant to cover modification and changes within the scope and spirit of the present invention.

I claim:

1. A bumper for covering an edge formed at the junction of structure sidewalls comprising:

a corner edge cover for engaging said structure sidewalls and edge, said cover having cover wall segments connected at adjacent ends to define a cover junction;

a resilient central arcuate shield wall segment spaced outwardly from said corner edge cover;

a plurality of resilient shield wall legs, each shield wall leg connecting tangentially to an opposite side of said arcuate shield wall segment and extending to connect to one of said cover wall segments, said arcuate shield wall segment and said shield wall legs integrally connected to form a shield wall extending away from the cover wall segments in a first direction; and a top plate integrally connected to top edges of said cover wall segments and extending away from and between said cover wall segments in a second direction, opposite said first direction, whereby said top plate restricts the separation of said cover wall segments from said structure sidewalls during impact of an object with said shield wall.

2. The bumper according to claim 1, wherein an arcuate span of said arcuate shield wall segment is between 150° and 210°.

3. The bumper according to claim 1, wherein the shield wall is spaced from said corner edge cover so that inversion of said shield wall is prevented during impact with an object.

4. The bumper according to claim 3, wherein a planar distance δ between said cover junction and a center of said arcuate shield wall segment is approximately equal to $$\delta = \delta_{crit} = hK\left[-0.1555\left(3 + 2\left(1 - \frac{25.24}{K^2}\right)^{\frac{1}{2}}\right)\gamma + 0.7775\right]$$

when K>5.02 and is approximately equal to $$\delta = \delta_u = hK\left[\gamma\frac{\lambda}{\eta^2}K - 1\right]\left[\frac{1 - \cos\eta}{\eta\sin\eta} - \frac{1}{2}\right]$$

when K≦5.02, where $$K = \frac{R}{h}\theta_o^2$$

R=mean radius of said arcuate shield wall segment $\theta_o$=half-angle of said arcuate shield wall segment, h=thickness of said arcuate shield wall segment, γ equals the ratio of a buckling load for an arch with relaxed boundary conditions to a value of said buckling load for an arch with fixed boundary conditions, and λ and η are a solution-pair of the characteristic equation $$\frac{\lambda^2K^2}{\eta^4}\left[4 - \frac{5\eta^2}{3} - 3\eta\cot\eta - \eta^2\cot^2\eta\right] -$$

-continued $$2\lambda\frac{K}{\eta^2}[2 - \eta^2 + \eta\cot\eta - \eta^2\cot^2\eta] +$$

$$\left[\eta\cot\eta - \eta^2\cot^2\eta - \frac{1\eta^2}{3} - \frac{\eta^4}{3K^2}\right] = 0.$$

5. The bumper according to claim 1, wherein said corner edge cover, said shield wall and said top plate are made of a material having a durometer in the range of 75–95 Shore A.

6. The bumper according to claim 5, wherein said material is a low migration plastic.

7. The bumper according to claim 1, further comprising peelable adhesive film is applied to a bottom surface of said top plate.

8. The bumper according to claim 1, wherein said top plate is formed to provide a flexible tab.

9. A bumper for covering the edges of a plate having two corner edges, said bumper comprising:

a corner edge cover comprising a plurality of cover wall segments integrally connected to conform to the geometric configuration of the sidewalls of said plate adjacent said corner edges;

a plurality of shield walls, each shield wall having an arcuate shield wall segment spaced outwardly from said cover wall segments and a plurality of shield wall legs extending tangentially from the ends of said arcuate shield wall segment and integrally connecting to said corner edge cover;

wherein two of said shield wall legs attach to one of said cover wall segments for overlying a plate surface disposed between said corner edges.

10. The bumper according to claim 9, wherein said corner edge cover and said plurality of shield walls are elongated.

11. The bumper according to claim 10, wherein said cover wall segments are formed to provide tabs for accommodating adhesive material.

12. The bumper according to claim 10, wherein an elongated strip of adhesive material is applied to said elongated corner edge cover.

13. The bumper according to claim 12, wherein the adhesive material is a double-backed adhesive film having a peelable adhesive side and an opposite permanent adhesive side.

* * * * *